United States Patent [19]

Martelli et al.

[11] Patent Number: 4,535,267

[45] Date of Patent: Aug. 13, 1985

[54] GETTER ASSEMBLY WITH IMPROVED SUPPORT

[75] Inventors: Daniele Martelli; Giuseppe Lani, both of Milan, Italy

[73] Assignee: SAES Getters S.p.A., Milan, Italy

[21] Appl. No.: 549,406

[22] Filed: Nov. 7, 1983

[30] Foreign Application Priority Data

Nov. 11, 1982 [IT] Italy ..... 24192 A/82

[51] Int. Cl.[3] ..... H01J 29/94

[52] U.S. Cl. ..... 313/481; 313/558; 313/559; 313/561; 417/48; 445/55

[58] Field of Search ..... 313/481, 553, 558, 559, 313/561; 417/48; 445/55

[56] References Cited

U.S. PATENT DOCUMENTS

| | | | |
|---|---|---|---|
| 3,385,420 | 5/1968 | Della Porta | 206/4 |
| 3,829,730 | 8/1974 | Reash et al. | 313/174 |
| 4,101,247 | 7/1978 | Pirota et al. | 417/48 |
| 4,323,818 | 4/1982 | Madden et al. | 313/481 |

FOREIGN PATENT DOCUMENTS

| | | |
|---|---|---|
| 2036019 | 1/1972 | Fed. Rep. of Germany . |
| 11453 | 2/1975 | Japan . |

*Primary Examiner*—Arthur Kellogg

*Attorney, Agent, or Firm*—Quaintance & Murphy

[57] ABSTRACT

A getter assembly is described which has an improved support such that the points of contact with the glass wall of a cathode ray tube have as low a temperature as possible.

A tab member for mounting the getter device is attached to the lower side of a central disc shaped zone of the getter device formed of an upraised bottom portion of the bottom wall of the ring getter. Said tab member extends without touching the inner side wall of the getter material container of its bottom wall. A support means is attached, for example by spot welding, to the tab member, and has at least two concave surfaces facing the bottom wall of the container and lying in a plane perpendicular to the outwardly extending zone of the tab member. The support means can be attached to the tab in the same area as which the tab is attached to the central zone of the upraised bottom portion of the container.

7 Claims, 6 Drawing Figures

FIG 4
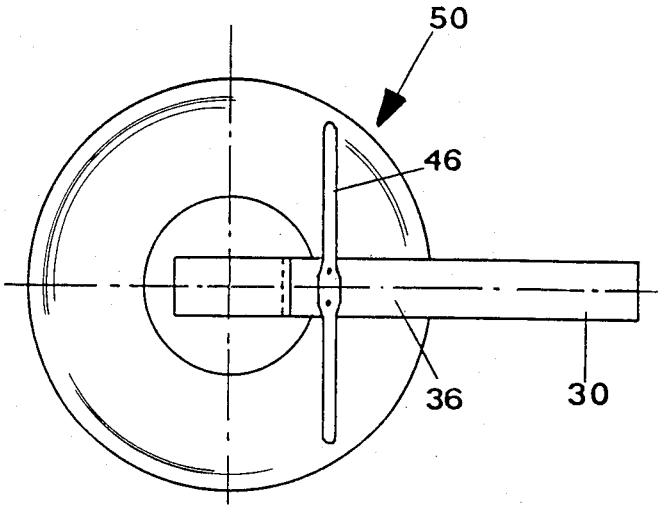
FIG 5
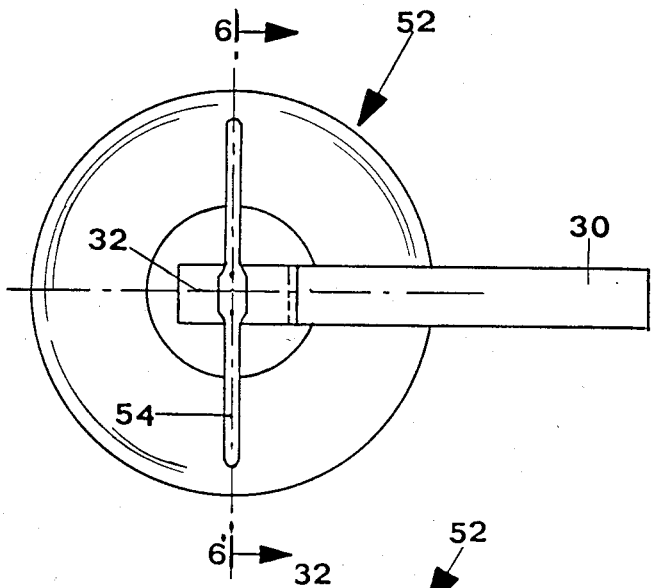
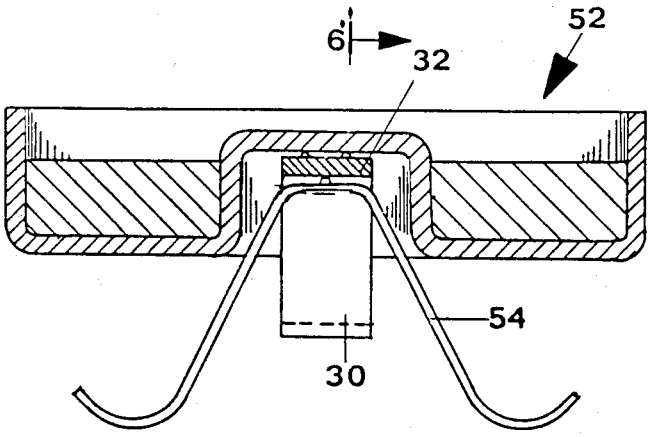
FIG 6

GETTER ASSEMBLY WITH IMPROVED SUPPORT

BACKGROUND TO THE INVENTION

Getter assemblies are well known in the art. They are extensively used in display tubes such as cathode ray tubes. In use the getter assembly is heated to a high temperature, usually by means of high frequency induction heating whereupon a getter metal, usually barium, is caused to evaporate from the getter assembly. The getter assembly, within the cathode ray tube, may be located in the antenna position or fixed to the anode buttom. However, whatever its position it is usually in contact with the inner surface of the glass envelope which forms the cathode ray tube.

Unfortunately the high temperature, 1000° C. or more reached by the getter assembly during evaporation of the getter metal is such as to cause cracking of the glass envelope. It has thus become customary to provide some form of thermal insulation or support between the getter material holder and the glass wall. Ceramic insulators have been used, as described in U.S. Pat. No. 3,381,805 or wire supports, as described in U.S. Pat. No. 4,101,247. Another type of support is described in Japanese utility model application publication No. 50-11453.

Nevertheless such insulating or support means are either expensive or have too high a temperature at the point of contact between the support and the glass envelope.

OBJECTS OF THE INVENTION

It is therefore an object of the present invention to provide a relatively inexpensive means of ensuring that the points of contact between the getter assembly and the glass wall of a cathode ray tube remain at a sufficiently low temperature during getter metal evaporation that cracking of the glass envelope is avoided.

Further objects and advantages will become obvious to those skilled in the art with reference to the following description and drawings wherein:

BRIEF DESCRIPTION OF THE DRAWINGS

FIG. 4 is a bottom view of a getter assembly using a support means of FIG. 3.

FIG. 5 is a bottom view of a getter assembly using an alternative support means of the present invention.

FIG. 6 is a cross-sectional view of the getter assembly of FIG. 5 taken along lines 6–6'.

DESCRIPTION OF THE INVENTION

Figure 1:
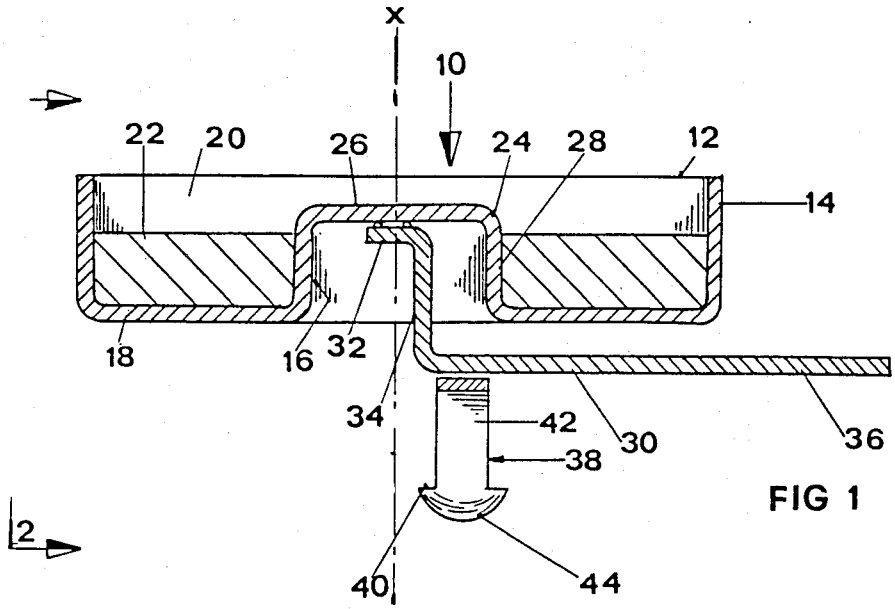
FIG. 1 is a diagramatic representation of a cross-sectional view of a getter assembly of the present invention.
Figure 2:
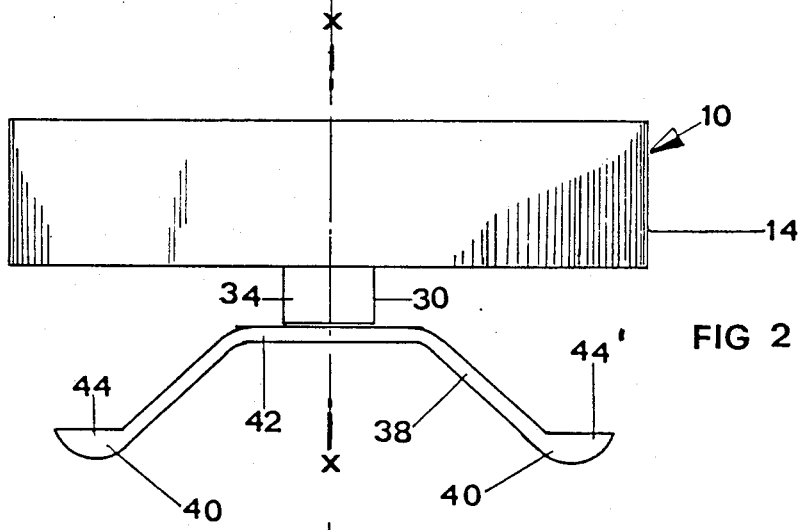
FIG. 2 is an end view taken along arrows 2–2' of FIG. 1.

Referring now to the drawings 1 and 2 in which like parts are indicated by the same members there is shown a getter assembly 10 comprising an annular getter material container 12 having an outer side wall 14, an inner side wall 16 and a bottom wall 18 which joins outer side wall 14 to inner side wall 16. Thus defining an annular channel 20. Annular channel 20 contains powdered getter material 22 which is generally a mixture of approximately 50% barium - 50% a luminium alloy with an approximately equal weight of nickel. The term "getter material" as used in the specification and claims herein is meant to include both the material prior to and after getter metal vapor release. This term embraces both the material in the form sold with the getter device and in the form in which it is found in an operating tube wherein the bulk of the getter metal has been evaporated from the material and is in the form of a film on the inside surfaces of the tube. The top 24 of the inner side wall is integrally formed round a disc shaped member 26 to form an upraised bottom portion 28.

A tab member 30 is affixed centrally of disc shaped member 26 by means of a horizontal welding zone 32. Integral with welding zone 32 is a downwardly dependent zone 34 which is distanced away from inner side wall 16 to minimize heat transfer to the tab and support (to be described later).

Tab member 30 further comprised an outwardly extending zone 36 which is situated in a plane substantially parallel to bottom wall 18 although a slight angulation may be used to suitably direct evaporating getter metal vapours. However outwardly extending zone 36 does not touch bottom wall 18 and is preferably separated therefrom by at least 0.5 mm. This prevents tab member 36 withdrawing heat from getter material container 12 through bottom wall 18 and prevents the formation of a colder area of getter material 22 during evaporation of getter metal vapours. Outwardly extending zone 36 extends to a distance greater than the radius of the outer side wall 14.

A support means 38 is attached to tab member 30 and has two concave surfaces 40, 40' facing bottom wall 18 and lying in a plane perpendicular to the outwardly extending zone of tab member 30. Support means 38 comprises a metal strip 42 having depressions 44, 44' formed at its ends.

Figure 3:
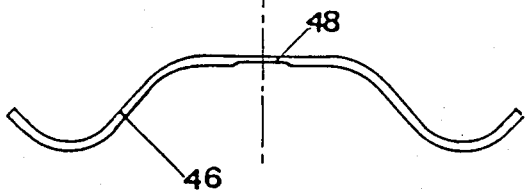
FIG. 3 is a representation of an alternative support means of the present invention.

FIG. 3 shows an alternative support means 46 for use in a getter assembly of the present invention and comprises a single length of circular cross section wire. The centre portion 48 is compressed to provide a flat surface for welding to tab member 30 and its ends are bent first downwardly and then upwardly.

FIG. 4 is a bottom view of a getter assembly 50 in which support means 46 is attached by welding to the outwardly extending zone 36 of tab member 30.

FIGS. 5 and 6 show a further embodiment of a getter assembly 52 of the present invention in which support member 54 is attached to the horizontal welding zone 32 of tab member 30.

A getter device as shown in FIGS. 3 and 4 was placed in an evacuated glass vessel and heated by induced currents. The maximum temperature of the point of contact between the support wire and the glass wall, as measured by a thermocouple was 570° C. The same measurement performed on a traditional getter device as shown in FIG. 3 of U.S. Pat. No. 4,101,247 showed a temperature of 700° C.

The lower temperature shown by the getter assembly of the present invention ensures no cracking of the glass wall of a cathode ray tube.

Although the invention has been described in detail with reference to certain preferred embodiments and applications it is intended that variations and modifications can be made within the spirit and scope of the invention as described and as defined in the following claims.

What is claimed is:

1. A getter assembly for a cathode ray tube comprising an annular getter material container having an outer side wall, an inner side wall and a bottom wall joining said outer side wall to said inner side wall so defining an annular channel which contains powdered getter material the top of said inner side wall being integrally formed round a disc shaped member to form an upraised bottom portion, a tab member is affixed centrally of said disc shaped member by means of a horizontal welding zone and further comprises a downwardly dependent zone which is distanced away from said inner side wall and an outwardly extending zone situated in a plane substantially parallel to said bottom wall without touching the bottom wall and extending to a distance greater than the radius of the outer wall and a support means attached to said tab member said support means having at least two concave surfaces facing said bottom wall and lying in a plane perpendicular to the outwardly extending zone of the tab member.

2. A getter assembly of claim 1 in which the distance between the outwardly depending portion of the tab member and the bottom wall is at least 0.5 mm.

3. A getter assembly of claims 1 in which the support means is a metal strip having depressions formed at its ends.

4. A getter assembly of claims 1 in which the support means comprises a single length of circular cross section wire whose centre portion is compressed to provide at least one flat surface and whose ends are bent first downwardly then upwardly.

5. A getter assembly of claim 1 in which the support means is attached to the outwardly extending zone of the tab member.

6. A getter assembly of claim 1 in which the support means is attached to the tab member centrally of the disc shaped member.

7. A getter assembly for a cathode ray tube comprising a getter material container having an outer side wall, an inner side wall and a bottom wall joining said outerside wall to said inner side wall so defining a channel which contains powdered getter material the top of said inner side wall being integrally formed round an upraised bottom portion, a tab member affixed centrally of said upraised bottom portion by means of a horizontal welding zone and further comprising a downwardly dependent zone distanced away from said inner side wall and an outwardly extending zone situated in a plane substantially parallel to said bottom wall and distanced therefrom by at least 0.5 mm, said outwardly extending zone extending to a distance greater than then outer wall and a support means comprising a single length of circular cross section wire whose centre portion is compressed to provide at least on flat surface attached to the outwardly extending zone of the tab member and whose ends are bent first downwardly and then upwardly.

* * * * *

UNITED STATES PATENT AND TRADEMARK OFFICE

CERTIFICATE OF CORRECTION

PATENT NO. : 4,535,267

DATED : September 5, 1985

INVENTOR(S) : Martelli, Daniele and Lani, Giuseppe

It is certified that error appears in the above-identified patent and that said Letters Patent are hereby corrected as shown below:

Claim 7, column 4, line 23 delete "then" and insert --the--.

Claim 7, column 4, line 25 delete "on" and insert --one--.

Column 1, line 14 delete "buttom" and insert --button--.

Column 1, line 68, delete "a luminum" and insert --aluminum--.

Claim 7, column 4, line 12 delete "outerside" and insert --outer side--.

Signed and Sealed this

*Twenty-sixth* Day of *November 1985*

[SEAL]

*Attest:*

DONALD J. QUIGG

*Attesting Officer*

*Commissioner of Patents and Trademarks*